United States Patent [19]

Bell et al.

[11] 4,024,730

[45] May 24, 1977

[54] INTEGRATED COOLING AND BREATHING SYSTEM

[75] Inventors: Richard L. Bell, Philadelphia; David N. DeSimone, Cornwells Heights, both of Pa.

[73] Assignee: United States of America as represented by the Secretary of the Navy, Washington, D.C.

[22] Filed: Mar. 25, 1976

[21] Appl. No.: 670,281

[52] U.S. Cl. ..... 62/259; 62/430; 128/142.5

[51] Int. Cl.[2] ..... F25D 23/12; F25D 11/00; A62B 7/00

[58] Field of Search ..... 62/259, 430; 128/142 R, 128/402, 142.5; 165/40

[56] References Cited

UNITED STATES PATENTS

| | | | |
|---|---|---|---|
| 3,064,448 | 11/1962 | Whittington | 62/259 |
| 3,161,192 | 12/1964 | McCormack | 62/259 |
| 3,174,300 | 3/1965 | Webb | 62/430 |
| 3,279,201 | 10/1966 | Wortz et al. | 62/259 |
| 3,343,536 | 9/1967 | Brisson et al. | 62/259 |
| 3,500,827 | 3/1970 | Paine | 62/259 |
| 3,744,555 | 7/1973 | Fletcher | 62/259 |
| 3,869,871 | 3/1975 | Rybalko et al. | 62/259 |

*Primary Examiner*—Lloyd L. King
*Attorney, Agent, or Firm*—R. S. Sciascia; Henry Hansen

[57] ABSTRACT

A system for providing cooling and breathing to a subject in an uncomfortably warm ambient environment such as in an aircraft. A full-length liquid loop garment, which is integral with a nylon fabric underwear-like suit, comprises a capillary-like system of flexible tubing which is filled with a coolant fluid and is attached by means of quick disconnects to a variable speed pump, which circulates the coolant in a continuous loop between the garment and a heat exchanger. As the coolant circulates through the system, heat absorbed from the person is transferred at the heat exchanger to a low temperature oxygen from a liquid oxygen converter, thus assisting complete vaporization of the oxygen and raising its temperature to a level suitable for breathing while providing cooling to the garment. The variable-speed motor may be automatically controlled, or may be manually controlled in order to increase or decrease the rate of flow of the coolant, thus allowing the individual to regulate cooling to his desired level.

10 Claims, 1 Drawing Figure

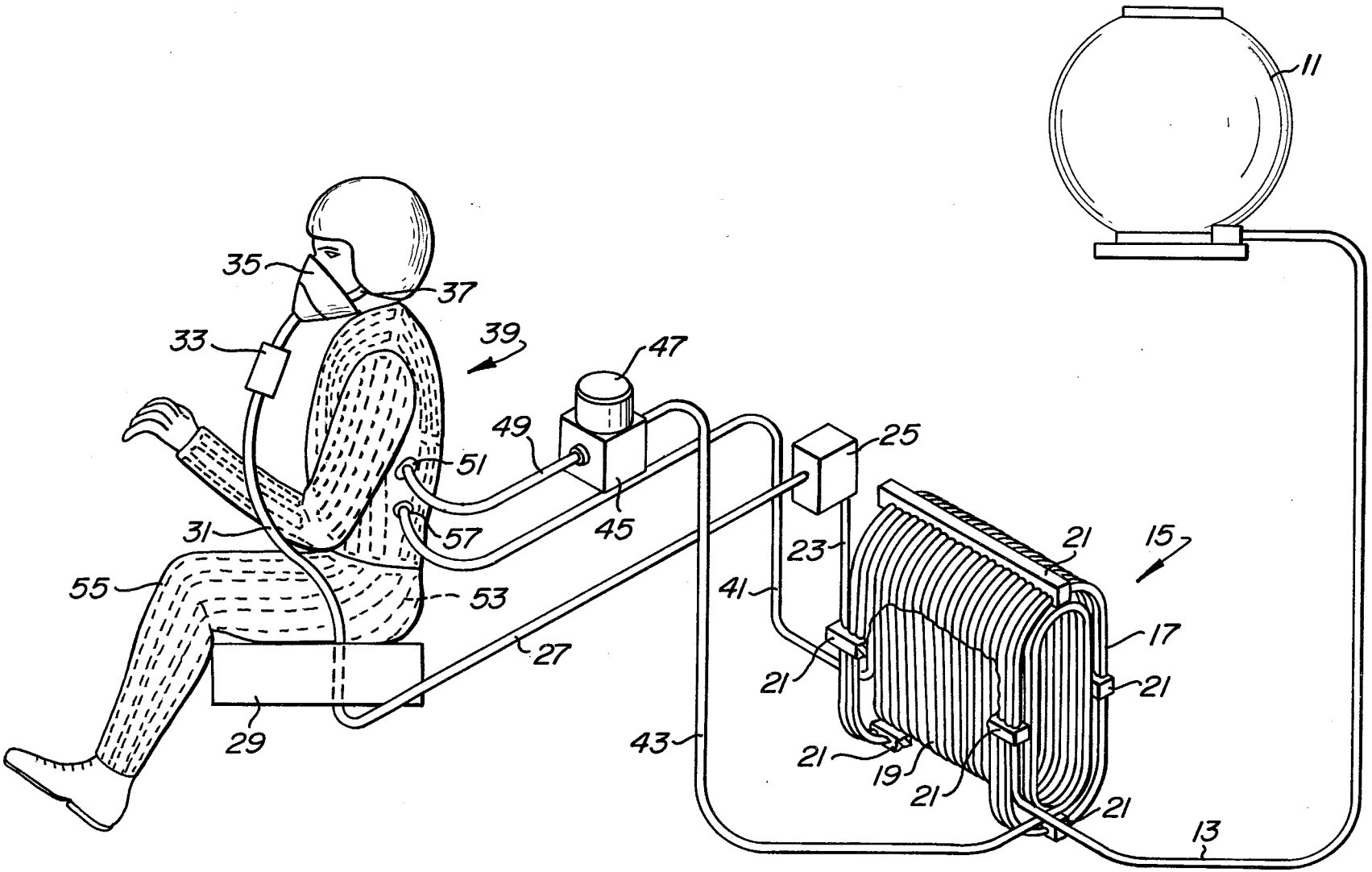
11
13
15
17
21
21
21
21
21
21
19
25
23
41
43
47
45
27
49
39
51
57
53
37
35
33
31
29
55

INTEGRATED COOLING AND BREATHING SYSTEM

STATEMENT OF GOVERNMENT INTEREST

The invention described herein may be manufactured and used by or for the Government of the United States of America for governmental purposes without the payment of any royalites thereon or therefor.

BACKGROUND OF THE INVENTION

The present invention relates to cooling and breathing systems for a subject, and more particularly to onboard cooling and breathing systems for crewman aboard an aircraft which employ a liquid loop cooling garment in conjunction with a breathing gas heat exchanger system.

An oxygen supply system is typically installed in aircraft to provide oxygen to crewmen on board while in flight. One such liquid oxygen system includes a liquid oxygen supply tank or converter containing a quantity of liquid oxygen under pressure. Complete vaporization of the oxygen is accomplished in a heat exchanger which consists of a series of coils of metal tubing exposed to the ambient air surrounding the aircraft and to which oxygen from the supply tank is provided. Oxygen gas leaving the heat exchanger should be of a temperature suitable for breathing when provided to the crewman. While in the heat exchanger, the temperature of the oxygen gas is also raised so that the gas is at a breathable temperature when provided to the crewman. Each crewmember is provided with an oxygen shutoff valve, a seat kit, a regulator, and a face mask with a head strap, for providing him with oxygen. Oxygen gas from the heat exchanger is conducted by supply lines through a console-mounted shutoff valve available to the crewman and thence through each crewman's seat kit which permits quick disconnect of the oxygen line in the event of ejection, and then through an individual regulator, which controls pressure and flow of oxygen gas to the face mask of the crewman.

One prior art method of cooling an aircrewman utilizes an electrical power source to power a motor and air blower unit, and large diameter hoses for routing air from the blower unit to and from the suit worn by the aircrewman. A ventilation ducting system would be incorporated into the crewman's suit. The disadvantages of this system are that a relatively large electrical power drain is required to operate the system, the air temperature is not regulated, and the system is bulky and tends to encumber the airman in the operation of the aircraft.

Another method of cooling an aircrewman uses engine bleed air extracted from a high pressure compressor stage of a turbine of the aircraft engine. Some engine bleed air is passed through an air refrigeration system, and mixed with engine hot bleed air and provided to the suit of the aircrewman. Large diameter hoses are also used in this system for routing the air to and from the airman. Although the air temperature can be regulated, this system cannot be operated unless the aircraft jet engine is in operation or an outside source of compressed air is provided. This system is also bulky and tends to encumber the airman in the operation of the aircraft. Futhermore, in an aircraft where several crewmen are employed, only one crewman, rather than each individual, would control the temperature of the air distributed to the suits of each of the crewmen.

SUMMARY OF THE INVENTION

Accordingly, it is the general purpose of the invention to provide a cooling and breathing system capable of providing breathing gas and cooling to a subject.

Other objects of the present invention are to provide a cooling system which does not require a substantial electrical power drain for its operation, which has individual regulation capability for regulating the amount of cooling provided to an individual, which permits a greater degree of freedom for the individual, and which will operate in an aircraft regardless of whether the aircraft engine is operating.

A further object of the present invention is to utilize very cold breathing gas to remove body heat from the subject while utilizing body heat to warm up the breathing gas.

Briefly, these and other objects are accomplished by passing a coolant fluid through coil tubes adjacent to the warmup coils of a liquified breathing gas heat exchange system, whereby the very cold liquified gas extracts heat from the coolant, thus lowering the temperature of the coolant. This coolant is circulated by a pump having a variable speed motor which the subject can control through a lightweight commercially available full-length liquid loop garment worn by each subject, thus cooling each subject. The coolant is then returned to the heat exchanger to again be cooled. By controlling the variable-speed motor, the subject can vary the rate of flow of the coolant in the garment, and thus can adjust the cooling provided by that garment to the desired level. The breathing gas vaporized and heated by the coolant fluid is provided to the subject for breathing.

Other objects, advantages and novel features of the invention will become apparent from the following detailed description of the invention when considered in conjunction with the accompanying drawing wherein:

BRIEF DESCRIPTION OF THE DRAWING

The drawing is a diagramatic representation of a breathing gas supply system together with a personal cooling system for an aircrewman according to the invention.

DESCRIPTION OF THE PREFERRED EMBODIMENT

Referring now to the drawing, the integrated cooling and breathing system according to the invention comprises a breathing supply system which includes a conventional insulated high pressure supply tank or converter 11 which contains a quantity (for example, ten liters) of liquid oxygen. Liquid air or any other liquified gas or mixture suitable for breathing when vaporized and warmed to an appropriate temperature can be used in this invention instead of liquid oxygen. Tank 11 is preferably constructed of insulated stainless steel to preserve the low temperature and thus the operating life of the liquid oxygen. Supply line 13 connects tank 11 with outer, or warmup, coils 17 of heat exchanger 15. Heat exchanger 15 comprises two sets of adjacent coils of metal tubing, an outer set 17 about an inner set 19, which are held separated from each other by spacers 21. It should be understood that heat exchanger 15 is illustrated in the drawing in a cutaway view in order to make inner coils 19 and their position with respect to outer coils 17 more readily viewable, and that outer coils 17 are actually continuous and not broken away. Flowing through inner coils 19 of heat exchanger 15 is a coolant fluid, further discussed below, whose temperature is higher than that of the liquid oxygen. Coils 17 and 19 are positioned adjacent to each other to permit heat transfer between the coils. As the liquid oxygen flows through outer coils 17 of heat exchanger 15, heat transfer takes place between the liquid oxygen and the coolant fluid via adjacent coils 17 and 19, and between the liquid oxygen and the ambient outside air to which the heat exchanger 15 is exposed. As a result of this heat transfer, the liquid oxygen is vaporized and further warmed so that it will have a temperature suitable for breathing upon arriving at the face mask 35 of the individual crewmember 39. The oxygen gas resulting from vaporization of the liquid oxygen leaves the outer coils 17 of heat exchanger 15 via supply line 23, and passes through shutoff valve 25 by which the individual crewmember 39 can turn on or off the flow of oxygen gas from heat exchanger 15. The oxygen gas then passes from shutoff valve 25 via supply line 27 through seat kit 29. Seat kit 29 is located underneath the aircraft crewmember 39 and permits rapid disconnect of lines of the crewmember from other parts of the aircraft in the event of ejection. The oxygen gas passes from seat kit 29 through supply line 31 and conventional regulator 33 to face mask 35 by which crewmember 39 receives the oxygen gas. Regulator 33 automatically controls the flow and pressure of oxygen gas to the crewmember 39. Face mask 35 is held onto the head of crewmember 39 by means of head strap 37 or by other conventional means.

Crewmember 39 wears a conventional liquid loop cooling garment 55 which can for example comprise a capillary-like system of flexible tubing 53 integral with a nylon fabric underwear-like suit.

Inner coils 19 contain a coolant fluid whose temperature is higher than that of the liquid oxygen. Heat exchange between the liquid oxygen and the coolant fluid via adjacent coils 17 and 19 of heat exchanger 15 results in lowering of the temperature of the coolant fluid. This coolant fluid can for example be water or an antifreeze mixture. The coolant fluid passes to and from the inner coils 19 of heat exchanger 15 by supply lines 41 and 43. Supply lines 41 and 49 carry coolant fluid to and from the tubing 53 of suit 55 by quick disconnects 51 and 57. The direction of flow is unimportant, so long as one of the two lines 41 and 49 carries coolant fluid into the suit and the other line carries body temperature heated coolant fluid out of the suit, since tubing 53, quick disconnects 51 and 57, supply lines 41, 43 and 49, pump 45, and inner coils 19 constitute a closed loop for coolant flow. Coolant fluid is pumped through this closed loop by pump 45 whose power is supplied by variable speed motor 47. As the coolant fluid circulates, heat absorbed from the crewmember 39 via tubing 53 of suit 55 is transferred via heat exchanger 15 to the liquid oxygen and low temperature oxygen gas contained in outer coils 17 thereby assisting in vaporizing the liquid oxygen and raising the temperature of the oxygen gas to a level suitable for breathing. This heat transfer also results in a decrease in temperature of the coolant fluid and thus provides the necessary cooling to the crewmember 39 by means of the coolant fluid flowing through tubing 53 of suit 55 worn by the crewmember 39. A low flow of liquid oxygen resulting from a low demand for oxygen gas or from other causes would not substantially affect cooling of crewmember 39, since the liquid oxygen and the oxygen gas contained in the outer coil 17 of heat exchanger 15 would be at a very low termperature. This very low temperature necessitates the spacing of outer coils 17 from inner coils 19 by spacers 21 in order to prevent freezing of the coolant fluid particularly when flow of the fluid is low. This could also be accomplished by insulating either or both of the coils 17 and 19 of heat exchanger 15. The amount of cooling provided to the individual crewmember 39 is directly proportional to the rate of flow of the coolant fluid. Thus the individual crewmember 39 can adjust the cooling provided by his suit 55 to the desired level by manually adjusting the speed of variable speed motor 47. Alternatively, the speed of variable-speed motor 47 could be controlled by a thermostat which is controlled by suit 55 termperature, body temperature of crewmember 39, by the temperature of the environment of crewmember 39, or by some other termperature as desired, in order to provide automatic control. Variable-speed motor 47 could instead be automatically controlled by some other automatic device.

It should be understood that this invention is not limited to use with liquid oxygen; liquid air or any other liquified gas or mixture suitable for breathing when vaporized and warmed to an appropriate temperature can be used in this invention instead of liquid oxygen. Also, this invention is not limited to use with the coolant fluids mentioned previously; any other temperature - conductive fluid could be used instead. If there is a situation of no coolant flow that could cause freezing of the coolant in inner coils 19, a bypass could be installed in the closed coolant loop so that inner coils 19 are bypassed when variable-speed motor 47 is shut off. Alternatively, a heating unit could be used to apply heat to heat exchanger 15 in the event of insufficient coolant flow. Also, heat exchanger 15 as used in the present invention could be exposed to outside air or to cabin air. In addition, this invention could be used to cool an individual working in a warm environment. This invention could also be used with non-human subjects such as animals. Furthermore, the garment used with this invention need not comprise a capillary-like network of tubing; other suits, such as a compartmentalized suit, could be used instead.

In summary, vaporization and warmup of liquid oxygen is accomplished in heat exchanger 15 by heat transfer with ambient air and with a coolant fluid which has been heated by the body heat of crewman 39 and flows through inner coils 19 of heat exchanger 15. The resulting oxygen gas is provided to the face mask 35 of crewman 39. The coolant fluid extracts heat from, and thereby cools, crewman 39 as it flows through tubing 53 of garment 55. Pump 45 having variable-speed motor 47 circulates the coolant fluid in a closed loop between tubing 53 and inner coils 19.

Thus there has been provided a novel cooling and breathing system which is capable of providing breathing gas and cooling to an individual. In this system, body heat of an individual is used to assist in evaporation and warmup of a liquid cryogenic breathing gas and the cryogenic liquid is used to provide cooling to the individual. This cooling reduces the temperature of the thermal environment and significantly improves the comfort of the individual which would be especially important in hot environments. The individual is provided with means for manually adjusting his cooling to his desired level, or such adjustments can be made automatic. Since no refrigeration unit is used in this invention, the power required for operation of this invention is relatively low. The garment employed in this invention will permit greater freedom of movement than if a garment for air ventilation were used. If used in an aircraft, this invention will operate regardless of whether the aircraft engine is operating.

Obviously, many modifications and variations of the present invention are possible in light of the above teachings. It is therefore to be understood that within the scope of appended claims the invention may be practiced otherwise than as specifically described.

What is claimed is:

1. an integrated liquid loop cooling and breathing system for a subject, comprising:

a supply of a liquified breathing gas;

a heat-conductive fluid;

a breathing gas mask formed to be worn by the subject;

cooling means formed to be worn by the subject for circulating said heat-conductive fluid therethrough; and a heat exchanger having first and second flow paths in heat transfer relationship to each other, said first path operatively connected to conduct said gas between said supply and said mask, and said second path operatively connected to conduct said fluid to said cooling means thereby cooling said heat-conductive fluid with said breathing gas.

2. A cooling and breathing system as defined in claim 1 further comprising:

first control means operatively connected between said heat exchanger and said mask for controlling the rate of flow of said breathing gas; and second control means operatively connected to said cooling means for controlling the rate of flow of said heat-conductive fluid in said cooling means and said heat exchanger.

3. A cooling and breathing system as defined in claim 1 wherein said cooling means comprises:

a garment formed to be worn by the subject and including means for conducting said fluid therethrough; and closed loop means operatively connected to said heat exchanger and to said garment for circulating said fluid therethrough.

4. A cooling and breathing system as defined in claim 3 wherein said conducting means comprises: a capillary-like system of flexible tubing distributed within said garment.

5. A cooling and breathing system as defined in claim 2 wherein said second control means comprises:

pump means operatively connected to said cooling means for circulating said fluid in said cooling means and said heat exchanger.

6. A cooling and breathing system as defined in claim 5 wherein said pump means further comprises:

a variable-speed motor for powering said pump means.

7. A cooling and breathing system as defined in claim 6 wherein said variable-speed motor further comprises:

selector means for manual adjustment of the speed of said variable-speed motor.

8. A cooling and breathing system as defined in claim 6 wherein said variable-speed motor further comprises:

thermostat means for automatic adjustment of the speed of said variable-speed motor according to sensed temperature.

9. A cooling and breathing system as defined in claim 1 wherein said first control means comprises:

valve means operatively connected between said heat exchanger and said mask for turning on or off the flow of said gas.

10. A cooling and breathing system as defined in claim 1 wherein said first control means comprises:

regulator means operatively connected between said heat exchanger and said mask for regulating flow and pressure of said gas to said mask.

* * * * *

UNITED STATES PATENT AND TRADEMARK OFFICE

CERTIFICATE OF CORRECTION

PATENT NO. : 4,024,730

DATED : May 24, 1977

INVENTOR(S) : Richard L. Bell and David N. DeSimone

It is certified that error appears in the above-identified patent and that said Letters Patent are hereby corrected as shown below:

Column 6, line 32, change "1" to -- 2 --.

Column 6, line 37, change "1" to -- 2 --.

Signed and Sealed this

Second Day of May 1978

[SEAL]

*Attest:*

RUTH C. MASON
*Attesting Officer*

LUTRELLE F. PARKER
*Acting Commissioner of Patents and Trademarks*